United States Patent [19]

Malone

[11] Patent Number: 4,659,099

[45] Date of Patent: Apr. 21, 1987

[54] FOOD AND ITEM TRAY FOR A WALKER AND A WHEELCHAIR

[76] Inventor: Charlotte Malone, 55 W. 4th St., Huntington Station, N.Y. 11746

[21] Appl. No.: 842,906

[22] Filed: Mar. 24, 1986

[51] Int. Cl.[4] ..... A47C 7/68

[52] U.S. Cl. ..... 280/289 WC; 108/44; 248/311.2; 312/235 R; 297/153

[58] Field of Search ..... 280/289 WC; 297/148, 297/149, 153, 145, 135, 188, 194; 108/44; 312/235 R; 211/126, 133, 74; 248/311.2

[56] References Cited

U.S. PATENT DOCUMENTS

| | | | |
|---|---|---|---|
| 2,278,414 | 4/1942 | Carlson | 297/153 |
| 3,146,738 | 9/1964 | Telarico | 297/154 UX |
| 3,512,826 | 5/1970 | Hahn | 211/126 |
| 3,635,522 | 1/1972 | Kerwit | 297/153 |
| 4,449,750 | 5/1984 | Pultman | 280/289 WC |
| 4,491,257 | 1/1985 | Ingles | 280/289 WC |
| 4,526,419 | 7/1985 | Bowman et al. | 297/153 |
| 4,580,803 | 4/1986 | Davis | 280/289 WC |

*Primary Examiner*—John A. Pekar

[57] ABSTRACT

A food and item tray is provided for a walker and a wheelchair and consists of a lightweight basket that has a plurality of mounting clamps for attachment to the walker and the wheelchair and a removable lightweight housing supported in the basket. The housing has a plurality of built-in various sized compartments for holding items such as a dish, cup, silverware and the like which will prevent the items from spilling out therefrom.

3 Claims, 4 Drawing Figures

FOOD AND ITEM TRAY FOR A WALKER AND A WHEELCHAIR

BACKGROUND OF THE INVENTION

1. Field of the Invention

The instant invention relates generally to attachments for walkers and wheelchairs and more specifically it relates to a food and item tray for a walker and a wheelchair.

2. Description of the Prior Art

Numerous attachments for walkers and wheelchairs have been provided in prior art that are adapted to carry various objects. For example, U.S. Pat. Nos. 3,957,071; 4,074,683, 4,212,493 and 4,403,786 all are illustrative of such prior art. While these units may be suitable for the particular purpose to which they address, they would not be as suitable for the purposes of the present invention as heretofore described.

SUMMARY OF THE INVENTION

The food and item tray attaches to a walker or wheelchair. It consists of a lightweight housing with built-in covered compartments for a dish, cup, silverware and the like. Handy covers for some of the compartments prevents items from spilling out therefrom. A basket for supporting the housing comes with mounting clamps for easy attachment to the walker or the wheelchair and features wing bolts for properly holding the mounting clamps to the walker or the wheelchair.

A principle object of the present invention is to provide a food and item tray for a walker and a wheelchair that will overcome the shortcomings of the prior art devices.

An additional object is to provide a food and item tray for a walker and a wheelchair that comes with mounting clamps for easy attachment to the walker and the wheelchair.

Another object is to provide a food and item tray for a walker and a wheelchair that includes a lightweight housing with built-in covered compartments for a dish, cup, silverware, etc. which prevents items spilling therefrom.

A further object is to provide a food and item tray for a walker and a wheelchair that is simple and easy to use.

A still further object is to provide a food and item tray for a walker and a wheelchair that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
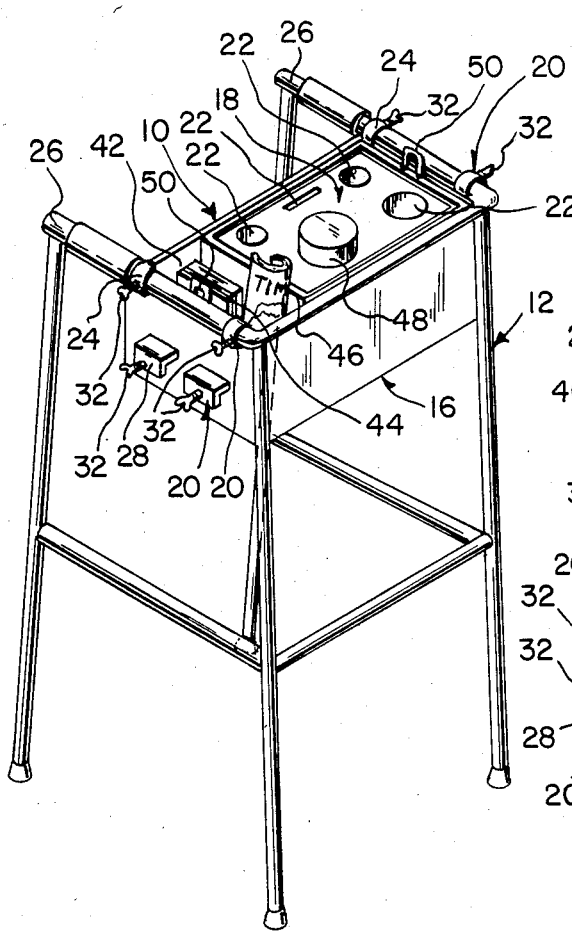
FIG. 1 is a perspective view of the invention attached to a walker.
Figure 2:
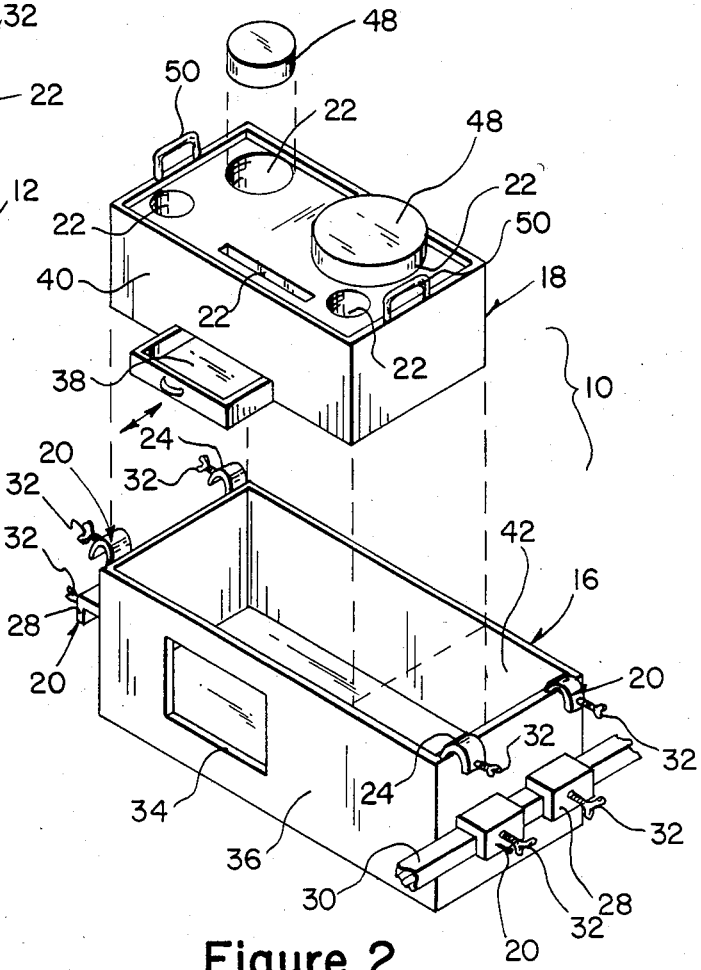
FIG. 2 is an enlarged perspective view of the invention with parts exploded therefrom.
Figure 3:
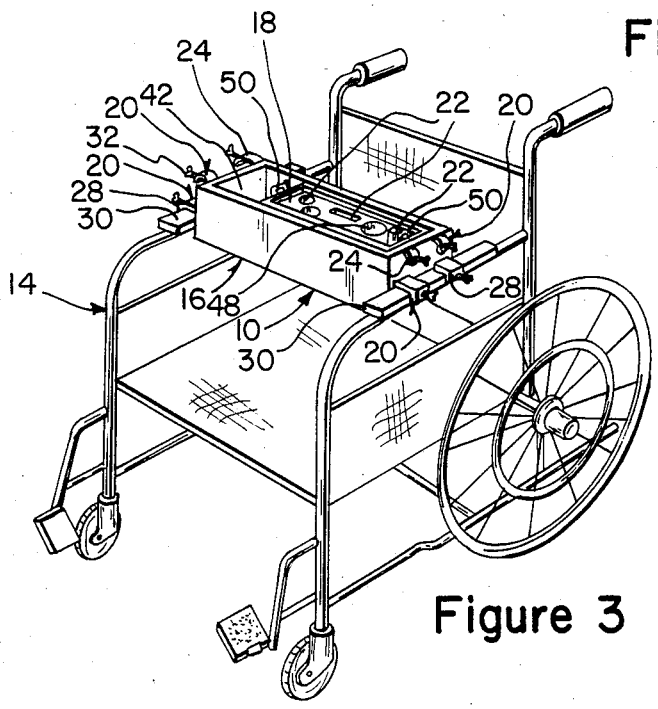
FIG. 3 is a perspective view of the invention attached to a wheelchair.
Figure 4:
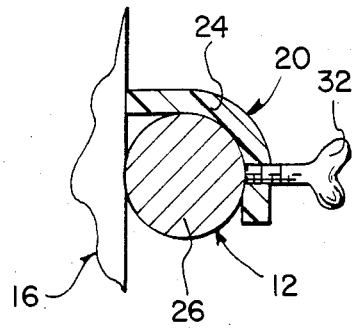
FIG. 4 is an enlarged sectional view of one of the clamps attached to an arm section of the walker.

Turning now descriptively to the drawings, in which similar reference characters denote similar elements throughout the several views, FIGS. 1 through 4 illustrates a food and item tray 10 for a walker 12 and a wheelchair 14. The tray 10 consists of a lightweight basket 16 and a removable lightweight housing 18. The basket 16 has a plurality of mounting clamps 20 for attachment to the walker 12 and the wheelchair 14. The housing 18 is supported in the basket 16. The housing 18 has a plurality of built-in various sized compartments 22 for holding items such as a dish, cup, silverware and the like which will prevent the items from spilling out therefrom.

The mounting clamps 20 include a first set of curved brackets 24 formed extending outwardly from opposite top ends of the basket 16 to engage with framework 26 of the walker 14. A second set of L-shaped brackets 28 are formed extending outwardly from opposite middle ends of the basket 16 to engage with arm rests 30 of the wheelchair 14. Wing bolts 32 are for holding the first set of curved brackets 24 to the framework 26 of the walker 12 and holding the second set of L-shaped brackets 28 to the arm rests 30 of the wheelchair 14.

The basket 16 is fabricated out of plastic material and has a large slot 34 in one of the longer sides 36. The housing 18 is fabricated out of plastic material and has an elongated rectangular shape smaller in length than the basket 16. The housing 18 has a small drawer 38 in one of the longer sides 40. When the housing 18 is inserted within the basket 16 the drawer 38 can extend through the large slot 34. A recepticle 42 is created between end of the housing 18 and the basket 16 for holding a book 44, newspaper 46 and the like therein.

Covers 48 are provided that are threadable within each of some of the built-in compartments 22 which will increase protection of the items from spilling out therefrom. The housing 18 further contains a pair of handles 50. Each handle is formed extending upwards from an opposite top end of the basket 18 to be gripped for removal from and replacement in the basket 16.

Obviously the food and item tray 10 is readily producible using convention production techniques. In addition, all material mentioned in association with manufacture enjoy widespread availability not likely to change in this era of liberal commerce and trade policies.

The basket 16 and the housing 18 could be produced in a vacuum-forming process. Thermoplastic sheets are first heated until they are soft enough to be easily shaped. They are then forced into the desired shape by vacuum or suction forming over male or female molds. As the sheet is usually clamped around the edges during forming, it must be trimmed afterward. Because of the distortion that occurs during forming, any holes are also punched after the piece has been formed.

The plastic mounting clamps 20 could be provided through extrusion. In this process, the raw material is pressed through a long heating chamber by a continuously rotating screw or a hydraulic plunger. At the end of the chamber, the heated material is forced through an opening of the desired shape and size and is carried away by a conveyer belt. The piece is then cooled by air or water and cut to size. The entire food and item tray 10 would be assembled in a modern assembly-line production process.

The food and item tray 10 could be packaged inside a heavy-duty cardboard box. Corrugated cardboard inserts could be included to keep the product from shifting. The outside of the box should feature a full product description, including color, style, and catalog number.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A food and item tray for a walker and a wheelchair which comprises:

(a) a lightweight basket having a plurality of mounting clamps for attachment to said walker and said wheelchair, said basket fabricated out of plastic material having an elongated rectangular shape and a large slot in one of longer sides, said mounting clamps including a first set of curved brackets formed extending outwardly from opposite top ends of said basket to engage with framework of said walker and a second set of L-shaped brackets formed extending outwardly from opposite middle ends of said basket to engage with arm rests of said wheelchair;

(b) a removable lightweight housing supported in said basket, said housing having a plurality of built-in various sized compartments for holding items such as dish, cup, silverware and the like which will prevent said items from spilling out therefrom, said housing fabricated out of plastic material having an elongated rectangular shape smaller in length than said basket, said housing having a small drawer in one of longer sides so that when said housing is inserted within said basket said drawer can extend through said large slot and a receptacle is created between end of said housing and said basket for holding a book, newspaper and the like therein; and (c) a plurality of wing bolts for holding said first set of curved brackets to said framework of said walker and holding said second set of L-shaped brackets to said arm rests of said wheelchair.

2. A food and item tray as recited in claim 1, wherein said housing further comprises a plurality of covers, each of said covers being threadable within each of some of said built-in compartments which will increase protection of said items from spilling out therefrom.

3. A food and item tray as recited in claim 2, wherein said housing further comprises a pair of handles, each said handle formed extending upwards from an opposite top end of said basket to te gripped for removal from and replacement in said basket.

* * * * *